United States Patent [19]

Weber

[11] 4,180,762

[45] Dec. 25, 1979

[54] DRIVER CIRCUITRY FOR PLASMA DISPLAY PANEL

[75] Inventor: Larry F. Weber, Urbana, Ill.

[73] Assignee: Interstate Electronics Corp., Anaheim, Calif.

[21] Appl. No.: 903,126

[22] Filed: May 5, 1978

[51] Int. Cl.[2] ..... H05B 37/00; H05B 39/00; H05B 41/00

[52] U.S. Cl. ..... 315/169.4; 340/789

[58] Field of Search ..... 315/169 R, 169 TV, 169.2, 315/169.4; 340/324 M, 789, 805

[56] References Cited

U.S. PATENT DOCUMENTS

| | | | |
|---|---|---|---|
| 4,070,600 | 1/1978 | Butler et al. | 340/324 M |
| 4,097,856 | 6/1978 | Lamoureux et al. | 315/169 TV |

*Primary Examiner*—Alfred E. Smith
*Assistant Examiner*—Robert E. Wise
*Attorney, Agent, or Firm*—Knobbe, Martens, Olson, Hubbard & Bear

[57] ABSTRACT

Sustainer drive circuitry for an AC plasma display panel wherein a multiple level sustainer signal is applied to panel electrodes along one axis only. The sustainer circuit includes a pair of series connected NPN pull-high and pull-down output driver transistors which (a) are respectively driven by low voltage drive circuits isolated from the NPN output driver transistors by capacitors; (b) respectively charge up the panel to a relatively high voltage and discharge the panel to ground; and (c) include a feedback network for limiting the rise time of the high voltage across the panel for reducing noise and electromagnetic interference. Diode circuitry insures that these output driver transistors are turned on and off without ringing and are never driven on simultaneously. A common voltage supply provides both (a) the write pulse level and (b) the write pedestal level of the sustainer waveform. The invention further provides a border sustain driver circuit for one axis which comprises simple and inexpensive integrated circuit logic gates.

13 Claims, 8 Drawing Figures

DRIVER CIRCUITRY FOR PLASMA DISPLAY PANEL

BACKGROUND OF THE INVENTION

Gas plasma panels having an inherent memory were originally disclosed in U.S. Pat. Nos. 3,499,167—Baker et al and 3,599,190—Bitzer et al. These panels have several inherent advantages over the cathode ray tube display and are presently used commercially, principally as digital data read-out devices. A problem associated with the state of the art technology is that the drive and control circuitry for the panel has been trouble prone and expensive in view of the number of circuits required and the complexity of these circuits.

One of the reasons for the circuit complexity has been the nature of the panel itself. Basically, the panel consists of two glass plates with a gas mixture sealed between them. A plurality of X-axis electrodes are deposited on the interior substrate of one plate and a plurality of Y-axis electrodes are deposited on the interior of the other plate, thereby providing a plurality of intersecting X and Y electrodes. A voltage of between 200 and 250 volts is required to discharge the gas between intersecting electrodes to emit light at this point. A lesser alternating current voltage will sustain the gas in the light emitting state, such that the gas will emit a pulse of light at each transition of the applied AC waveform. A precisely timed, shaped and phased multiple level alternating voltage waveform is required to control the generation, sustaining and erasure of light emitting gas discharges at the selected locations on the plasma display panel.

Typically in the prior art systems, a multiple level alternating voltage sustainer drive signal is applied to both the X and Y electrodes, so as to present a composite sustainer waveform across the gas at each point or cell in the display panel where the X and Y electrodes intersect. As a result, each of the X and Y electrodes are required to be driven by a complex sustainer circuit. Moreover, not only is a sustainer circuit required for both the X and Y set of electrodes, but in addition, a plurality of digital logic elements are required to generate a plurality of timed pulse trains for controlling the on and off intervals of the transistors within each of the X and Y sustainer circuits.

Another disadvantage of the prior art sustainer drive circuits is that they commonly utilize inductances and transformers as energy storage elements and isolation devices. These are ordinarily high-cost items, resulting in a further increase in the cost of manufacture of the overall system. In addition, it has been difficult to make the prior art circuits reliable. Thus, for example, the stray inductances associated with the panel tends to result in deleterious ringing of the output drive transistors of the sustainer circuits.

SUMMARY OF THE INVENTION

The present invention relates to improved driver circuitry for an AC plasma panel having a number of significant features.

In the preferred embodiment of the invention described herein, the sustainer waveform is applied only to the electrodes forming one axis of the plasma panel. As a result, there is a substantial amount of driver circuitry which is unnecessary in the present invention, since not only is a sustainer circuit for the other set of electrodes unnecessary, but in addition, there is no need to provide the logic circuitry needed to drive a second sustainer drive circuit.

The sustainer drive circuit of the invention includes a pull-high output transistor connected in series with a pull-down output transistor with the sustainer drive signal being produced at the node common to both transistors. Both of these transistors are controlled by low voltage, base drive circuits. The pull-high transistor, in the on state, connects this common node to the voltage supply corresponding to the highest level of the sustainer waveform, i.e., at a level between 170 and 200 volts and typically 180 volts. The pull-down transistor, when energized, connects the node to ground potential. The sustainer drive circuit includes a number of significant advantages. Low cost, high reliability capacitors are used for isolating the low voltage base drive circuits from the high voltage output transistors. This is in contrast to prior art designs which typically utilize relatively expensive inductors or transformers for this purpose.

Another feature of the invention is that although the base of the pull-high transistor floats up and down with a high voltage close to the voltage applied to the plasma panel, the inherent problems of driving a transistor so connected are solved by this invention such that this pull-high output transistor turns on and off without ringing and without the use of inductors, transformers, and additional power supply voltages. In addition, the sustainer drive circuit requires a reduced number of input pulse trains for generating the requisite sustain waveform. Thus, in the preferred embodiment described herein, five input pulse trains suffice to produce a four level sustainer waveform. Further savings are achieved over the prior art by using a reduced number of power supply voltages and using the same voltage source to produce both the write pulse and the write pedestal voltage level of the sustainer output waveform.

The present invention further incorporates a feedback network for limiting the rise time of the sustainer voltage applied to the plasma panel when the pull-high transistor is turned on. This effectively reduces unnecessary noise currents and electromagnetic interference that would otherwise be generated by very rapid change of current with time when the panel is charged by the pull-high transistor.

Another feature of the present sustainer circuit is that diode means are provided to ensure that the pull-high and pull-down transistors are not turned on simultaneously so as to avoid excessive current flow through each of these transistors.

In addition to simplifying the sustainer drive circuitry, the present invention further provides a substantial reduction in circuit complexity for driving the border electrodes forming one set of axes. Thus, in the embodiment described herein, one set of axis borders are not driven with a special sustainer circuit, but instead with commercially available, low cost integrated circuit transistor gates.

DETAILED DESCRIPTION OF PREFERRED EMBODIMENT

Overall System

Figure 1:
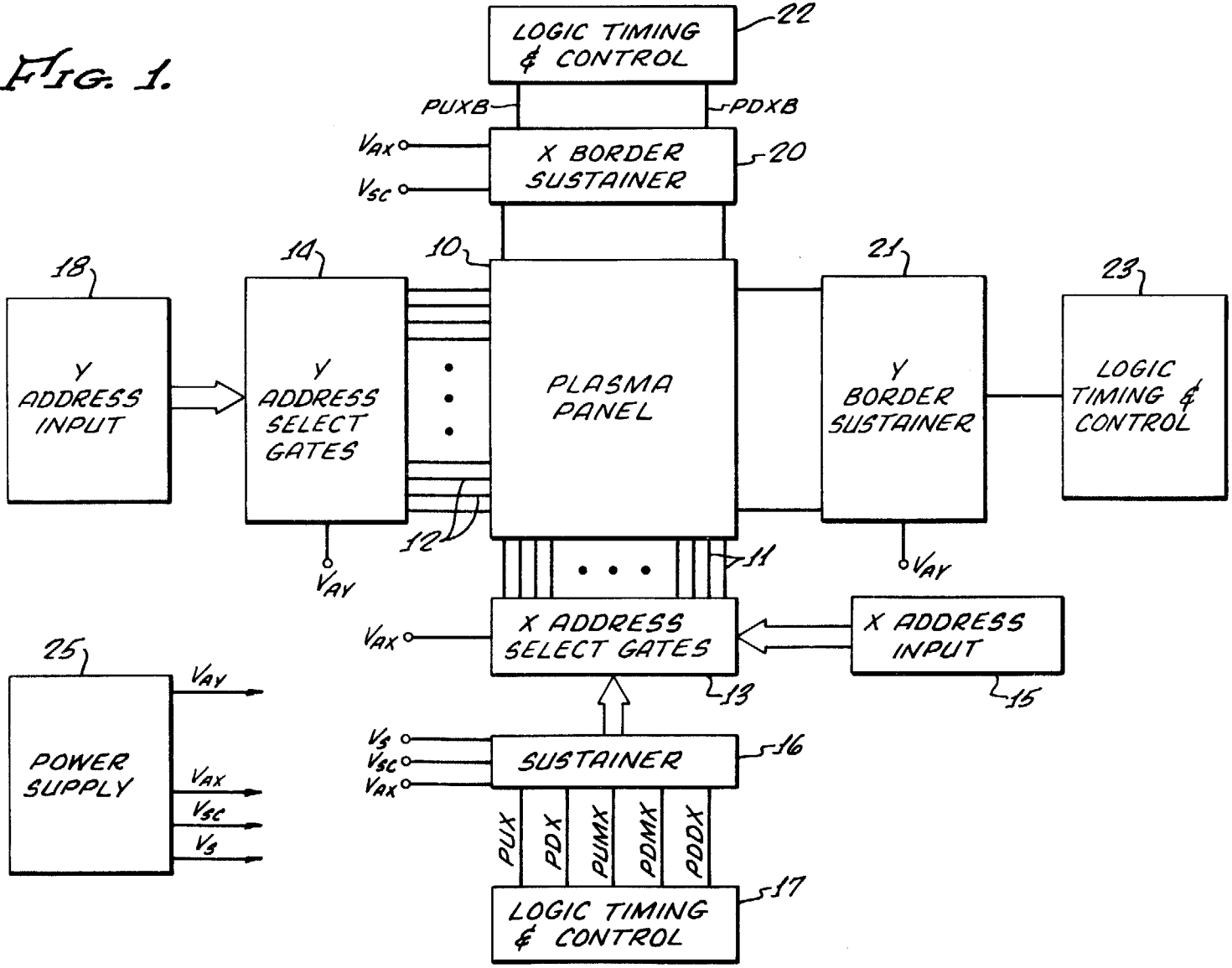
FIG. 1 is a block diagram of the overall system for driving an AC plasma panel in accordance with the present invention.

Referring to FIG. 1, plasma panel 10 is of the AC type with inherent memory, as originally disclosed in U.S. Pat. Nos. 3,499,167—Baker et al and 3,559,190—Bitzer et al. Basically, this type of plasma panel comprises two glass plates having a gas mixture sealed between. There are a plurality of vertical electrodes (denoted herein as the X-axis electrodes 11) deposited on the interior substrate of one plate and a plurality of horizontal electrodes (denoted herein as the Y-axis electrodes 12) deposited on the interior of the other plate, forming a matrix. By way of representative example, such a matrix typically comprises 512 X-axis electrodes and 512 Y-axis electrodes. When the proper voltage waveform is applied to intersecting X and Y electrodes (denoted herein as the addressing mode), the gas between the electrodes discharges a bright dot of light at the point or cell of the electrode intersection. Discharges in the gas gap produce free electrons and gas ions which collect on the walls of the gas cell. This wall charge provides the storage or inherent memory for this type of display. As long as an AC sustaining voltage is applied to the panel, the gas will emit light without further addressing.

The circuitry for addressing any one of the plurality of interactions of the horizontal and vertical electrodes is provided by the X address select gates 13 and the Y address select gates 14 respectively connected to the X-axis electrodes 11 and Y-axis electrodes 12. The X address select gates 13 are in turn responsive to an X address input stage 15 and driven by a sustainer circuit 16 which is operatively connected to a plurality of pulse trains, PUX, PDX, PUMX, PDMX, and PDDX, provided by a logic timing and control circuit 17.

The Y address select gates 14 are responsive to a Y address input stage 18. A significant feature of the present invention is that the Y address select gates 14 are not driven by a sustainer circuit, thereby eliminating essentially one-half of the sustainer circuitry used by commercially available AC plasma displays to date.

The nature of the plasma panel is such that special sustain voltages are applied to the panel borders as a means for priming the plasma cells so that the panel may be reliably written. Accordingly, as shown, an X border sustainer circuit 20 is connected to the X-axis borders and a Y border sustainer circuit 21 is connected to the Y-axis borders. The X border sustainer circuit is driven by pulse trains PUXB and PDXB generated by a logic timing and control circuit 22. The Y border sustainer circuit is driven by logic timing and control circuit 23. As described below, a feature of the present invention is that the Y border sustainer circuit 21 is considerably simplified over the prior art.

Each of the foregoing described circuits are responsive to one or more voltages $V_{AY}$, $V_{AX}$, $V_{SC}$ and $V_S$ supplied by power supply 25. Not shown are two additional voltage sources; typically 14 volts, for supplying power to the integrated circuit logic in the X address select gates 13 and Y address select gates. As will be apparent from the description below, another feature of the invention is the reduction in number of different power supply voltages that are required to provide the requisite sustainer voltage waveform.

Sustainer Waveform

Figure 2A:
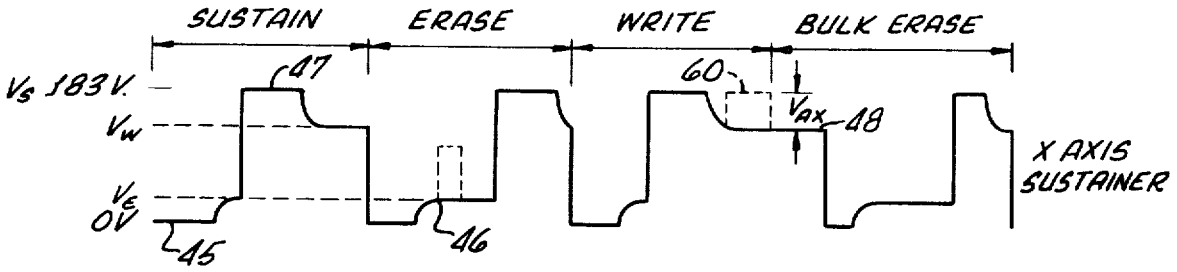
FIGS. 2(*a*) and 2(*b*) illustrate the waveform supplied to the X-axis and Y-axis electrodes of the preferred embodiment of this invention.
Figure 2B:
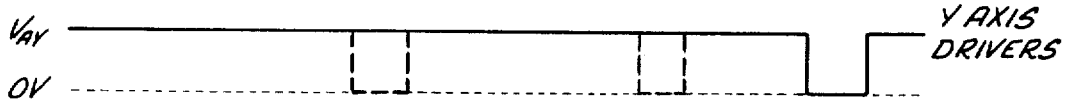

FIG. 2(*a*) illustrates the waveform of the sustainer alternating voltage applied to the X axis electrodes 11 in the four operating modes of sustain, erase, write, and bulk erase. FIG 2(*b*) illustrates the waveform applied to the Y-axis electrodes 12 during the same operating mode. In FIG. 2(*a*), a solid line indicates a signal which is supplied to all of the X electrodes, whereas a dotted line indicates a signal on only those electrodes which are addressed. Likewise, in FIG. 2(*b*), the solid line indicates a signal which is applied to all of the Y electrodes, whereas the dotted line is the signal applied to only the addressed Y electrodes.

Simplified Block Diagram

Maximum, Erase and Low Sustainer Levels

Figure 3:
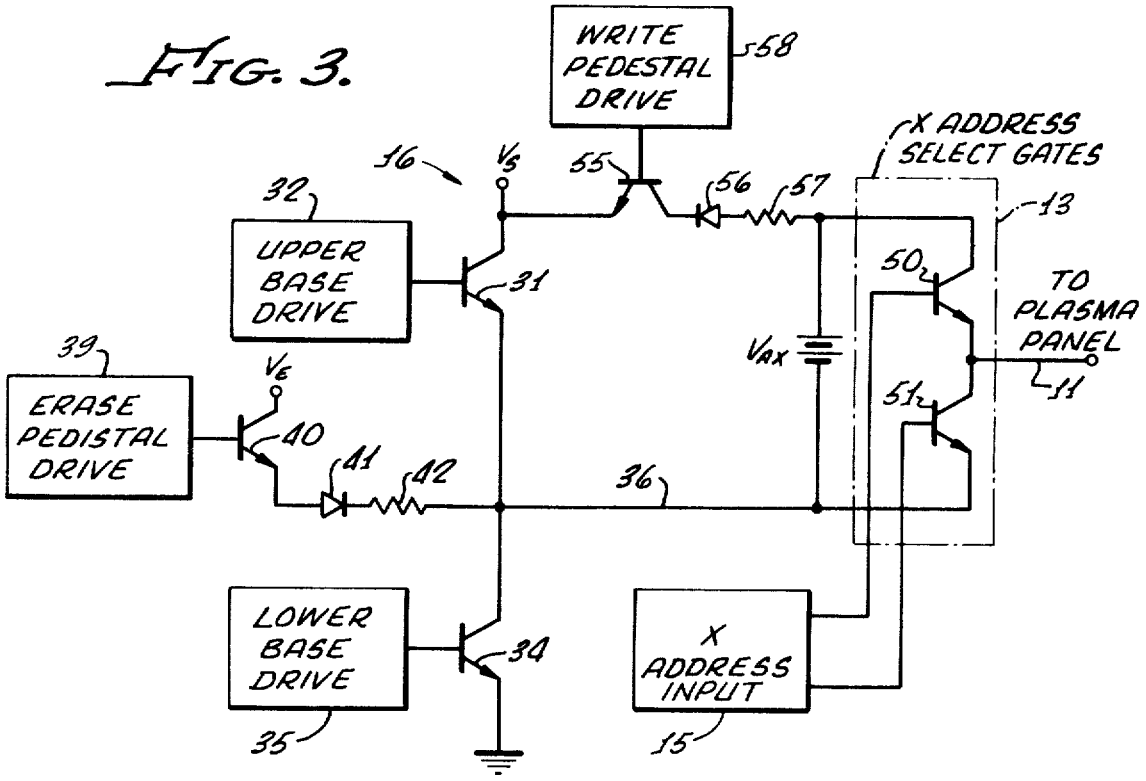
FIG. 3 is a simplified circuit schematic of the sustainer drive circuit used to drive the X-axis electrodes.

FIG. 3 is a simplified block diagram of the sustainer 16 and a single stage of the X address select gates 13. As shown, the sustainer 16 includes a pull-high output NPN transistor 31 driven by upper base drive circuit 32 and connected in series with a pull-down output NPN transistor 34 driven by lower base drive circuit 35 between potential $V_S$ and ground Panel sustainer drive line 36 is connected to the node common to both transistors, i.e., the emitter of transistor 31 and the collector of transistor 34. The erase pedestal level ($V_E$) is provided by output NPN transistor 40, driven by erase pedestal drive 39. The emitter of transistor 40 is connected to panel sustain drive line 36 via isolation diode 41 and resistor 42. The maximum sustainer level $V_S$ (shown at 47 in FIG. 2(*a*)) is achieved when transistor 31 is on. The low level potential for the sustainer drive line 36 (ground level as shown at 45 in FIG. 2(*a*)) is provided when transistors 31 and 40 are turned off and transistor 34 is driven on by lower base drive circuit 35. The intermediate or erase pedestal voltage level $V_E$ on line 36 (shown at 46 in FIG. 2(*a*)) is achieved when transistors 31 and 34 are turned off and transistor 40 is driven on by erase pedestal drive circuit 39.

Erasing a selected dot on the panel is performed in the erase mode by adding a pulse to the sustainer waveform applied to the selected X-axis electrode, and pulsing the selected Y-axis electrode to ground, as shown in FIGS. 2(*a*) and 2(*b*).

The bulk erase waveform erases all of the cells in the panel by applying a narrow pulse across all cells. This is accomplished by making all Y drivers fall shortly after the X sustainer voltage falls, as shown in FIGS. 2(*a*) and 2(*b*).

Write Sustainer Level

One of the features of the present invention is that it eliminates a separate voltage supply for providing the write pedestal level (shown at 48 in FIG. 2(*a*)). Referring to FIG. 3, floating voltage source $V_{AX}$ is connected across series connected gate transistors 50 and 51, these transistors representing one stage of a plurality of similar gating stages forming the address select gates 13.

The bases of these transistors are controlled by X address input stage 15 such that in normal operation, i.e., except when an X axis is to be addressed, the upper gate transistor 50 is off and the lower gate transistor 51 is on, thus connecting the plasma panel 10 through on transistor 51 to the panel sustain drive line 36.

As shown in FIG. 2(*a*), voltage level $V_{AX}$ is the voltage level of the write pulse 60 applied to the write pedestal 48 to address an X electrode. This same voltage source $V_{AX}$ is also used to provide the write pedestal level 48 in combination with the X address select gates 13 by virtue of transistor 55, isolation diode 56 and resistor 57 connected in series between $V_S$ and floating supply voltage $V_{AX}$. Transistor 55 is driven by write pedestal drive circuit 58.

During the write portion of the sustainer waveform (shown in FIG. 2(*a*)), transistor 55 is turned on by write pedestal drive circuit 58 and transistors 31, 34 and 40 are off. By virtue of transistor 55 being on, the voltage supplied to the panel sustain drive line 36 is $V_S$ minus $V_{AX}$, the requisite write pedestal level 48 shown in FIG. 2.

Addressing of selected X electrodes 11 is accomplished by supplying appropriate drive signals from the X address input stage 15 to the X address select gates connected to such selected X electrodes 11 such that the upper gate transistor 50 is driven on and the lower gate transistor 51 is driven off. The X axis electrode is then raised from the write pedestal level 48 to the write voltage $V_S$ (as shown by the dotted line pulse 60 of FIG. 2). As shown in FIG. 2(*a*), writing data at a selected X-Y intersection is accomplished by simultaneously lowering the selected Y electrode to ground.

Detailed Description of Sustainer Drive Circuit 16

Figure 4:
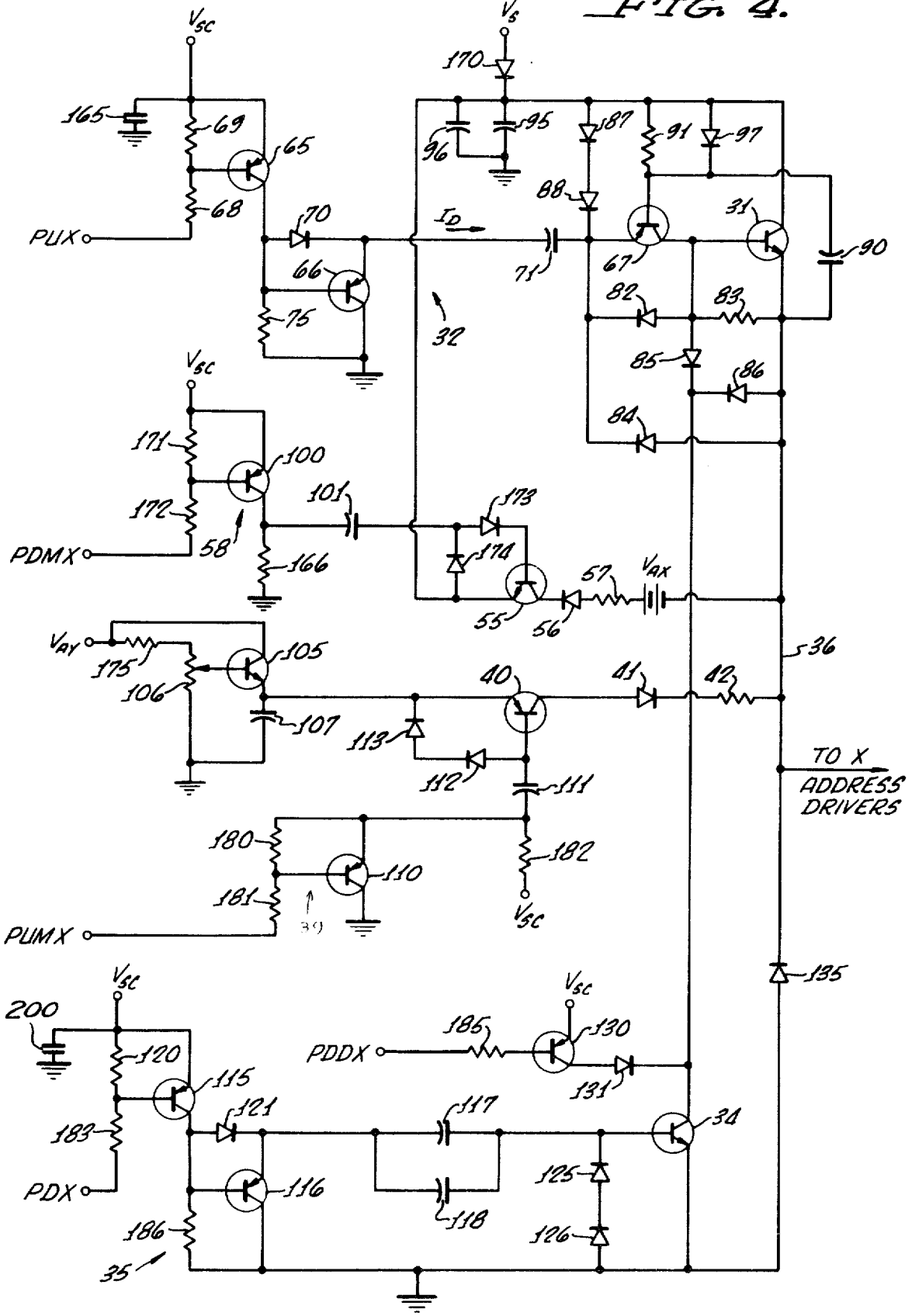
FIG. 4 is a detailed circuit schematic of the sustainer drive circuit.

A detailed circuit schematic showing the specific circuitry for the preferred embodiment sustainer drive circuit 16 is illustrated in FIG. 4. The requirements for this circuit is that it must drive a substantial panel capacitance, typically 5,000 to 10,000 pf with a voltage waveform ranging between 0 and 200 volts. For proper panel operation, the rise time of the sustainer voltage waveform should not exceed 500 ns. Thus, to charge up the panel capacitance, peak currents of 10 amperes are frequently required. The discharge current from the gas discharge panel 10 comes within one microsecond after the panel is charged up when all cells in the panel are illuminated. This discharge current may have resultant peak currents of the order of 10 amperes.

In order to increase power efficiency and minimize the thermal dissipation in the output drive NPN transistors 31 and 34 of the sustainer 16, these transistors are advantageously driven to saturation. However, the circuitry of the sustainer 16 must ensure that these transistors are not conducting at the same time, since such condition would cause very high power dissipation within the transistors. Another significant problem entailed in the sustainer drive circuit is that the base of the pull-high transistor 31 floats up and down with a voltage nearly equal to the voltage across the plasma panel, thereby making it most difficult to drive transistor 31.

The problems enumerated above are solved by the circuit of FIG. 4, without the use of inductors or transformers and without extra power supply voltages. In addition, the circuit of this invention limits the speed at which transistor 31 is turned on so that unwanted noise is not generated by an excessively high dI/dt when transistor 31 charges up the panel capacitance. Such an excessive rate of change of current would cause excessive electromagnetic interference (EMI) and other types of noise that can cause other circuits within the system to malfunction.

Pull-High Transistor 31 and Upper Base Drive 32

Figure 5:
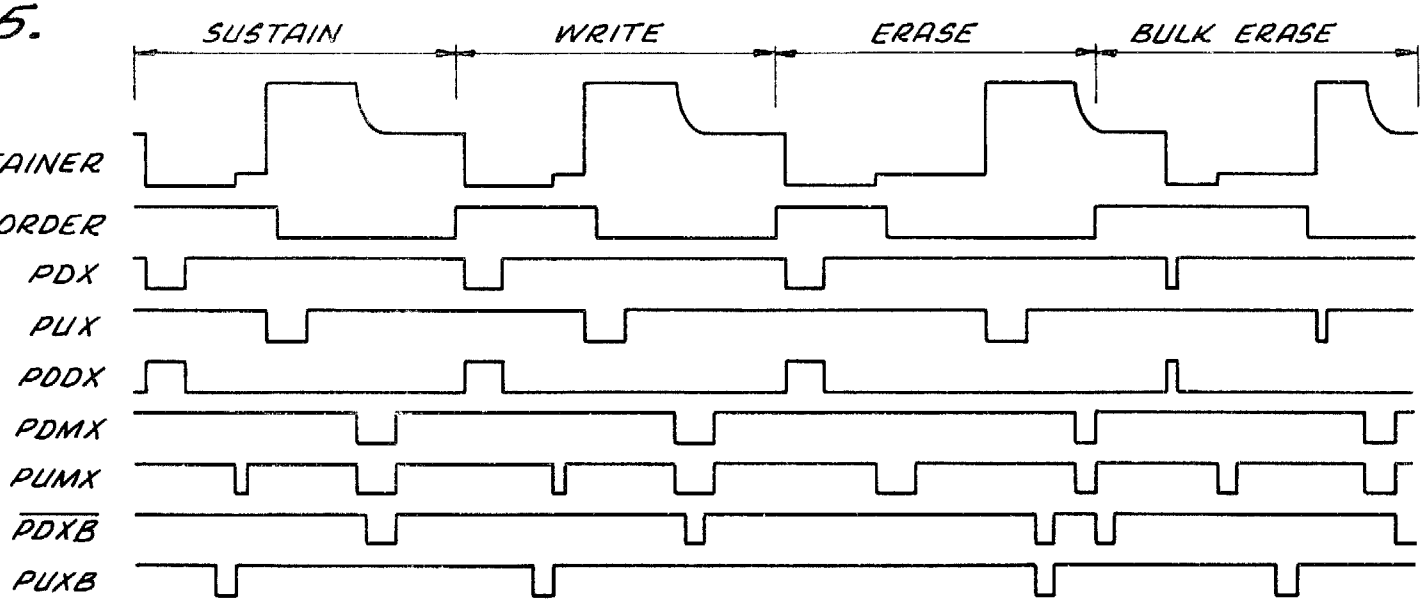
FIG. 5 illustrates the input pulse trains applied to the circuit of FIG. 4.

The pull-high transistor 31 pulls the sustainer signal level up to voltage $V_S$. The base of this transistor 31 is controlled by the low voltage, upper base drive circuit 32 including transistor 65 which controls transistors 66 and 67. Low voltage transistor 65 is supplied with power from low voltage source $V_{SC}$ and is responsive to pulse signal PUX connected to its base through resistor 68. As shown in FIG. 5, PUX is normally high, causing transistor 65 to be off because its base is held high by resistor 69. The maximum sustainer level 47 is initiated when PUX goes low, at which time current flows in the base emitter junction of transistor 65, turning it on and into saturation. The collector current of transistor 65 flows through diode 70, reverse biasing the base-emitter junction of transistor 66 and turning this transistor off.

Capacitor 71 provides high voltage isolation between the base of output transistor 31 and the low voltage drive circuit comprising transistors 65 and 66. This is a distinct advantage over the inductors and transformers of the prior art systems since the capacitor 71 is substantially less expensive without any loss in reliability. The voltage on the left electrode of the coupling capacitor 71 is pulled up when transistor 65 is on, causing a positive current $I_D$ to flow from the low voltage drive circuit into the capacitor 71 and into the emitter-base junction of transistor 67, pulling its collector up to a value near $V_S$, resulting in transistor 67 being turned. This also results in the base of pull-high transistor 31 being pulled up to turn on the pull-high transistor 31. Because of the high current flow into the base of transistor 31, the transistor saturates and its emitter rises to $V_S$ potential. As capacitor 71 charges up, current will continue to flow into the base of transistor 31, holding it on and saturated. Capacitor 71 is large enough so that it is never allowed to completely charge up. The arrangement of transistors 31 and 67 and capacitor 71 is such that stray inductances in the plasma panel and circuits will not cause transistor 31 to turn off and ring during the turn on operation.

When pulse input signal PUX is returned to its high state, transistor 65 is turned off by the base pull-up resistor 69. Transistor 65 then stops supplying current to capacitor 71, and instead, resistor 75 provides base current to transistor 66, which turns on. The emitter of on transistor 66 pulls the left electrode of capacitor 71 down to ground instantaneously. This capacitor, in turn, pulls the emitter of transistor 67 down, resulting in the turn off of this transistor. Capacitor 71 then discharges, resulting in a negative current $I_D$ into the low voltage drive circuit.

Turn Off of Output Transistor 31

Diodes 82, 84 and resistor 83 are used to turn transistor 31 off. Diode 82, connected across the emitter-collector of transistor 67, becomes forwardly biased when capacitor 71 discharges and pulls the stored charge out of the base of transistor 31, thereby turning this transistor off. Resistor 83 also assists in the turn off of transistor 31 by discharging its emitter-base junction. Diode 84 provides a current path to discharge the collector junction of transistor 31 which was forwardly biased when the transistor was saturated.

Avoiding Simultaneous Turn On of Output Transistors 31 and 34

As noted above, it is very important that output transistors 31 and 34 are not on simultaneously since they would then provide a short circuit across the high voltage supply $V_S$. Without diodes 85 and 86 however, transistor 31 would tend to turn on each time transistor 34 turns on because the emitter of transistor 31 is connected directly to the panel drive line (which is driven to ground when transistor 34 turns on), whereas the base of transistor 31 is tending to float above ground. Diodes 85 and 86 ensure that transistors 31 and 67 are turned off when pull-down transistor 34 is turned on. Thus, these diodes ensure that current from transistor 34 will pull the base of 31 down before it pulls down its emitter because the junction voltage across diode 85 is less than the sum of the drop across diode 86 and the emitter-base junction of transistor 31. Diode 86 is also used to couple the output collector of pull-down transistor 31 to the panel sustain drive line 36.

Diodes 87 and 88 clamp the reverse voltage across the base-emitter junction of transistor 67 to a low voltage of the order of 1.4 volts to protect this transistor and conduct any of the negative current $I_D$ that is not needed to pull charge out of transistors 31 and 67.

Limiting Rise Time of Sustainer Waveform

As described above, a significant feature of this invention is the limiting of the rise time of the high voltage sustainer signal, so that unnecessary noise currents are not generated that will cause other circuits of the system to malfunction. This feature is provided by feedback capacitor 90 and resistor 91, which feed back a current through resistor 91 connected in the base of transistor 67, thus slightly slowing the turn on time of this transistor. As a result, the turn on time of pull-high output transistor 31 is also slightly extended, thereby limiting the rise time of the voltage applied across the plasma panel on sustainer drive line 36.

Note that this feedback is accomplished in such a way that it does not add any impedance elements in the high current loop comprising capacitors 95 and 96, pull-high transistor 31, and the plasma panel. Any such impedance element in this high current loop would result in a voltage drop across the plasma panel at the time of a high discharge current spike and cause the plasma panel to exhibit undesirable electrical and optical characteristics. These deleterious effects are not produced by capacitor 90 and resistor 91 since they allow pull-high transistor 31 to be saturated and supply full current to the plasma panel at the time of the gas discharge current. Diode 97 is used to keep the feedback circuit from turning on transistors 31 and 67 when the plasma panel is discharged by pull-down transistor 34.

Write Pedestal Output Transistor 55 and Associated Drive Circuit 58

The write pedestal level 48 is provided by output transistor 55 and the write pedestal drive circuit 58 including transistor 100, responsively coupled to pulse input signal PDMX. When the PDMX input pulse is low, the transistor 100 is turned on, forcing current through capacitor 101, and causing transistor 55 to switch on. Immediately after pull-high transistor 31 is turned off, the sustainer signal is held to $V_S$ by the panel capacitance. Upon closing of transistor 55, the voltage $V_{AX}$ is clamped to $V_S$ and the output is reduced to the desired write pedestal level of $V_S$–$V_{AX}$.

Erase Output Transistor 40 and Erase Pedestal Drive 39

The erase sustainer level shown at 46 in FIG. 2 is provided by transistor 40 which pulls the sustainer waveform up to this voltage level when turned on. The emitter of transistor 40 is supplied from an emitter follower circuit comprising transistor 105. The collector of transistor 105 is tied to $V_{AY}$ and its base is connected to potentiometer 106 which allows adjustment of the emitter voltage of transistor 105 to the desired level. Decoupling capacitor 107 is connected between ground and the emitter of transistor 105.

The base drive of transistor 40 is supplied by erase pedestal drive circuit 39, including transistor 110. When the pulse drive signal PUMX goes low, as shown in FIG. 5, transistor 110 turns on, driving capacitor 111 to ground. This capacitor begins charging and provides base current for transistor 40. Transistor 40 turns on, and the sustainer output is pulled up through diode 41 and resistor 42 to the voltage level set by potentiometer 106. When pulse signal PUMX goes high, transistor 40 is turned off. Capacitor 111 then discharges through diodes 112 and 113. Resistor 42 is a current limiting resistor to reduce power dissipation in transistor 40. Diode 41 is a blocking diode used to isolate the circuit when the sustainer level on panel sustain drive line 36 is at a higher voltage level.

Pull-Down Transistor 34 and Lower Base Drive 35

The lower base drive circuit 35 for the pull-down transistor 34 includes transistors 115 and 116 and is a similar but somewhat simplified circuit as compared with the upper base drive circuit 32. Such simplification is made possible since the base of transistor 34 floats near ground potential. Parallel capacitors 117, 118 are analogous to capacitor 71 and supply current to the base of transistor 34 for both turn on and turn off. Transistor 115 is responsive to the input signal pulse signal PDX. This signal is normally high, causing transistor 115 to be off because its base is held high by resistor 120. When PDX goes low, current flows in the base emitter junction of transistor 115, turning it on and into saturation. The collector current of transistor 115 flows through diode 121, reverse biasing the base emitter junction of transistor 116, thereby turning it off. Coupling capacitors 117, 118 are then pulled up, causing a current to flow into the base of pull-down transistor 34, turning it on.

Diodes 125 and 126 act similarly to diodes 87 and 88 in maintaining a proper bias across the capacitors 117 and 118. Capacitors 117, 118 and diodes 125, 126 eliminate the need for an extra power supply by forcing the base of pull-down transistor 34 to a negative value with respect to ground when transistor 116 is turned on, thereby improving turn off of the base-emitter junction of transistor 34.

Figure 6:
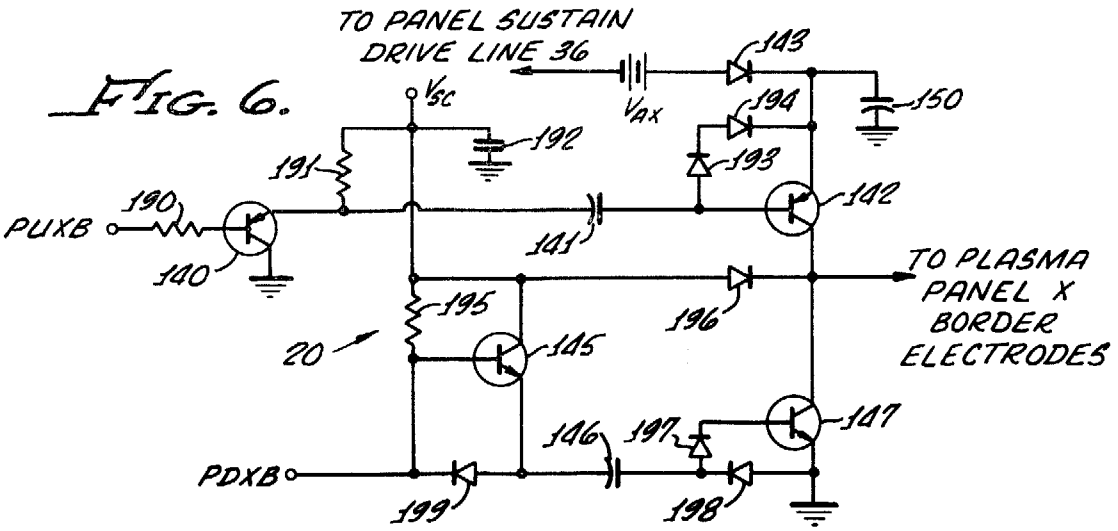
FIG. 6 is a detailed circuit schematic of the X border sustainer circuit.

Transistor 130 and diode 131 are used to pull charge out of the collector-base junction of transistor 34 in order to properly turn this transistor off from its saturated on state. Transistor 130 is responsive to input pulse train PDDX, and provides current to the collector junction of transistor 34 on turn-off. As shown in FIG. 6, the control signals PDX and PDDX are exact inverses. Thus, when PDX goes low to turn on transistor 115, PDDX goes high to turn off transistor 130, and conversely, when PDX goes high to turn off transistor 115, PDDX goes low to turn on transistor 130. Diode 131 prevents burn out of transistor 130 when pull-high transistor 31 is turned on.

Diode 135 is used to keep the voltage across the plasma panel from going negative due to stray inductances that are typically associated with the panel.

Detailed Description of X-Border Sustainer Circuit 20

A detailed circuit schematic of the X-border sustainer circuit 20 is shown in FIG. 6. When input pulse signal PUXB is high, transistor 140 is off and current is forced through capacitor 141 from the low voltage supply $V_{SC}$, causing the base-emitter junction of transistor 142 to be reverse biased and turned off. When PUXB is low, transistor 140 conducts and current flows out of the base of transistor 142 through capacitor 141, causing transistor 142 to conduct. This transistor is connected in series circuit with diode 143 and floating voltage source $V_{AX}$ between the panel sustain drive line 36 and the X-border electrodes. Accordingly, conduction of transistor 142 causes the X-border electrodes to be pulled up to a voltage equal to the sum of the sustainer drive signal and $V_{AX}$ (typically of the order of 250 volts).

When input pulse train PDXB is high, transistor 145 is on to force current through capacitor 146 and turn on transistor 147. Transistor 147 then pulls the X-border electrodes to ground potential. Conversely, when PDXB is low, capacitor 146 is pulled down, which pulls down the base of transistor 147 and turns it off.

Capacitor 150 sustains the X-border voltage when the sustainer voltage is low. Thus, when the sum of the sustainer voltage and $V_{AX}$ is at its highest voltage, current flows through diode 143 and charges this capacitor 150. The stored charge is sufficient to maintain the border potential until the sustainer waveform rises again to recharge the capacitor.

Detailed Description of Y-Border Sustainer Circuit 21

Figure 7:
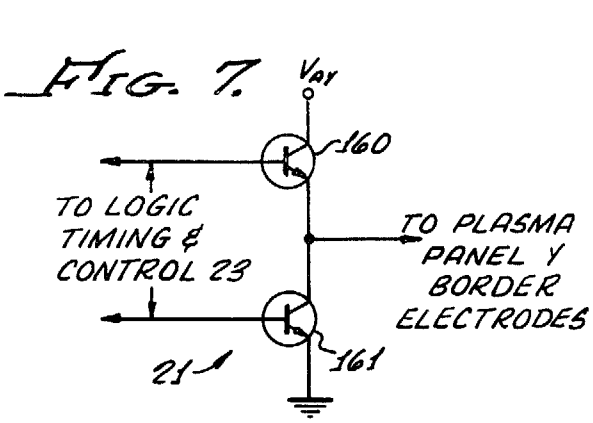
FIG. 7 is a detailed circuit schematic of the Y border sustainer circuit.

A significant feature of the present invention is that the Y border sustainer circuit 21, shown schematically in FIG. 7, is considerably less expensive and complex than the X border sustainer. Prior art border drive systems typically duplicate the X and Y border sustainer circuits since a relatively high voltage border drive signal has been required heretofore on both of these axes. However, it has been found that in the present invention, with the substantially higher sustain voltage applied to the X electrodes and X border electrodes, a relatively lower voltage Y sustainer drive signal, having a simple square waveform as shown in FIG. 5, functions quite satisfactorily. This lower voltage and substantially less complex waveform signal can be easily achieved by switching on and off low cost, integrated circuit gates, such gates also being used for the address select gates 14.

Referring to FIG. 7, transistors 160 and 161 represent a single stage of IC gates used to supply the Y border sustainer voltage to the Y border electrodes. The transistors are connected in series between voltage supply $V_{AY}$ (typically 70 volts) and ground. When transistor 160 is driven on by a logic control signal from the logic timing control circuit 23, the transistor 160 is turned on and transistor 161 off, such that the border electrodes are supplied with the voltage $V_{AY}$. Conversely, when transistor 160 is driven off and transistor 161 on, the border electrodes are driven to ground potential, as shown by the Y border waveform of FIG. 5. As shown in FIG. 5, the X and Y border sustainer signals are phased so that the sustaining voltage across the panel along its border cells is higher than the voltage across the panel at its display cells, so that the border cells are always driven on.

A further advantage of this Y border sustainer circuit is that the inexpensive IC gate circuits utilize the same supply voltage $V_{AY}$ that is used for the Y address select gates, thereby eliminating the need for any additional power supplies to provide the Y border sustainer driver signals.

Specific Circuit Components

A representative embodiment of the circuitry shown in FIGS. 1, 3, 4, 6 and 7 included the following specific circuit components:

| | |
|---|---|
| X axis select gates 13 (transistors 50, 51) | Texas Instruments SN 75426 |
| Y address select gates 14 | Texas Instruments SN 75427 |
| Transistors 31, 34 | General Semiconductor, Inc. XGSR10025 |
| Transistors 40, 105 | General Electric D45C11 |
| Resistors 42, 57, 191 | 51 ohm |
| Transistors 55, 147 | 2N6307 |
| Diodes 41, 56, 82, 84, 85, 86, 97 112, 113, 131, 135, 170, 173, 174 | 1N4936 |
| Transistors 65, 100, 115, 116, 130 | General Electric D45C1 |
| Transistors 66, 110, 140 | General Electric D45C3 |
| Transistors 67, 142 | 2N6212 |
| Resistors 68, 69, 120, 171, 172, 181, 183, 185, 190 | 100 ohm |
| Diode 70, 121, 125, 126, 143, 193, 194, 197, 198, 199 | 1N4933 |
| Capacitors 71, 95, 96, 101, 107, 111, 117, 118, 146 | 1 mf |
| Resistor 75, 186 | 200 ohm |
| Resistor 83 | 10 ohm |
| Capacitor 90 | 500 pf |
| Resistors 91, 166, 182 | 5 ohm |
| Potentiometer 106 | 2K ohm |
| Capacitor 141, 150 | 47 uf |
| Transistor 145 | General Electric D44C5 |
| Transistors 160, 161 | Texas Instruments SN 75427 |
| Resistor 175 | 3K ohm |
| Resistor 180 | 300 ohm |
| Capacitors 165, 192, 200 | 47 uf |
| Resistor 195 | 500 ohm |
| Diode 196 | 1N3936 |
| Voltage Supply $V_{SC}$ | 5 volts |
| Voltage Supply $V_S$ | 180 volts |
| Voltage Supply $V_{AX}$ | 70 volts (floating) |
| Voltage Supply $V_{AY}$ | 70 volts |

What is claimed is:

1. A sustainer drive system for an AC plasma panel, said panel having plural electrodes respectively forming the X and Y axes thereof, said drive system comprising:
   - means for supplying a sustainer waveform across the panel comprising a single sustainer circuit;
   - means for coupling said single sustainer circuit to those panel electrodes which form only one of said axes;
   - said single sustainer circuit including:
     - an NPN pull-high output transistor connected in series with an NPN pull-down output transistor between a high voltage and ground, with the sustainer drive signal being produced at the node common to both transistors, the base of said pull-high transistor floating up and down at a high voltage close to the panel voltage;

low voltage base drive circuits coupled to, but isolated from said NPN pull-high and pull-low output transistors by respective first and second isolating capacitors;

means coupled to said pull-high transistor for preventing ringing thereof when said transistor is turned on and off; and means coupled to said pull-high and pull-low output transistors for insuring that both of said transistors are not driven on simultaneously.

2. A sustainer drive system for an AC plasma panel, said panel having plural intersecting electrodes respectively forming a plurality of cells at which light may be produced on the panel, said drive system comprising:

means for supplying a multiple level sustainer waveform across the panel comprising a single sustainer circuit;

means for coupling said single sustainer circuit to one electrode only at each of said intersecting cells;

said single sustainer circuit including a pull-high output transistor connected in series with a pull-down output transistor for selectively charging and discharging the panel by a sustainer drive signal produced at the node common to both of said transistors; and a low voltage base drive circuit coupled to, but isolated from, said pull-high output transistor by an isolating capacitor.

3. The sustainer drive system according to claims 1 or 2, further comprising:

feedback means coupled to said pull-high output transistor for feeding back a signal corresponding to the panel voltage for limiting the rise time of the sustainer waveform.

4. The sustainer drive system according to claim 3, wherein said feedback means comprises a series connected capacitor and resistor.

5. The sustainer drive system according to claims 1 or 2 further comprising a drive transistor having its emitter and collector connected between an isolating capacitor and the base of said pull-high transistor.

6. The sustainer drive system according to claim 3 including a drive transistor having its emitter and collector connected between said coupling capacitor and the base of said pull-high transistor, said feedback means including a capacitor connected between said pull-high output transistor and the base of said drive transistor and a resistor connected to the base circuit of said drive transistor.

7. The sustainer drive system according to claim 1, comprising means for turning off said pull-high transistor including a first diode connected between said first isolating capacitor and the base of said pull-high transistor for discharging the base of said pull-high transistor and a second diode connected between said first isolating capacitor and the emitter of said pull-high transistor for discharging the collector junction of said transistor when said transistor is turned off.

8. The sustainer drive system according to claim 7 comprising a resistor connected between the emitter and base of said pull-high transistor for discharging the emitter-base junction thereof when the transistor is turned off.

9. The sustainer drive system according to claims 1, 7 or 8 wherein said means coupled to said pull-high and pull-low output transistors for ensuring that said transistors are not driven on simultaneously comprises a first diode connected between the base of said pull-high transistor and the output of said pull-down transistor and a second diode connected between the emitter and base of said pull-high transistor, so that when the pull-down transistor turns on, current is pulled from the base of said pull-high transistor before it is pulled from its emitter junction, thus insuring that the pull-high transistor does not turn on when the pull-low transistor turns on.

10. The sustainer drive system according to claims 1, 2, 7 or 8 wherein a common voltage source supplies the write voltage level on the sustainer waveform and also provides the voltage level required for selective address pulsing of individual cells, comprising a voltage connected in series between said common node and a write pedestal drive transistor, such that when the pull-high and pull-low transistors are off and the pedestal drive transistor is on, the sustainer waveform is pulled down to the difference between the maximum level of said sustainer waveform and said additional voltage source; and means for coupling said common voltage source to address selector gates connected between said sustainer waveform to said panel electrodes.

11. The sustainer drive system according to claims 1, 2, 7 or 8 comprising means for sustaining the border electrodes along one of said axes in a continuous on state, comprising integrated circuit transistor gates connected between a voltage source less than the maximum sustainer voltage waveform for applying an alternating square waveform to said border electrodes.

12. A sustainer drive system for an AC plasma panel comprising:

a circuit for continuously driving only the border cells of said AC plasma panel, comprising:

first border sustainer means for supplying a two level border sustainer waveform to first border electrodes of said AC plasma panel forming one of said border axes; and second border sustainer means for supplying a single level sustainer waveform to second border electrodes forming the other of said border axes, said means comprising integrated circuit transistor gates connected in series to a voltage source lower than the maximum border sustain voltage supplied by said first means;

means for connecting said first border sustainer means only to said first border electrodes; and means for connecting said second border sustainer means only to said second border electrodes.

13. The sustainer drive system according to claim 12 further including address select gates comprising integrated circuit transistor gates for addressing selected display electrodes along said one axis, the same voltage source supplying the integrated circuit transistor gates of both said second border sustainer means and said address select gates.

* * * * *